US012060209B2

(12) United States Patent
Robert et al.

(10) Patent No.: US 12,060,209 B2
(45) Date of Patent: Aug. 13, 2024

(54) PLASTIC-FREE TRAPPED TRAY PACKAGING

(71) Applicant: Menasha Corporation, Neenah, WI (US)

(72) Inventors: Paul E. Robert, Lyndhurst, NJ (US); Greg Wicker, Fairport, NY (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 18/140,135

(22) Filed: Apr. 27, 2023

(65) Prior Publication Data

US 2023/0294895 A1 Sep. 21, 2023

Related U.S. Application Data

(63) Continuation of application No. 17/178,321, filed on Feb. 18, 2021, now Pat. No. 11,679,921.

(60) Provisional application No. 62/980,781, filed on Feb. 24, 2020.

(51) Int. Cl.
*B65D 73/00* (2006.01)
*B65D 77/00* (2006.01)

(52) U.S. Cl.
CPC ..... *B65D 73/0092* (2013.01); *B65D 77/003* (2013.01); *B65D 2203/00* (2013.01)

(58) Field of Classification Search
CPC ..... B65D 73/0092; B65D 73/005; B65D 75/006; B65D 75/36; B65D 2585/88
USPC ..... 206/461–463, 470, 471, 703, 705
See application file for complete search history.

(56) References Cited

U.S. PATENT DOCUMENTS

| | | | | |
|---|---|---|---|---|
| 3,184,319 | A * | 5/1965 | Fritsche | B65D 75/322 426/123 |
| 3,282,413 | A * | 11/1966 | Sparks | B65D 75/327 53/452 |
| 4,083,451 | A | 4/1978 | Hair | |
| 4,125,190 | A * | 11/1978 | Davie, Jr. | B32B 3/28 206/532 |
| 4,779,734 | A | 10/1988 | Kydonieus | |
| 6,326,069 | B1 * | 12/2001 | Barnett | B65D 75/30 206/229 |
| 6,691,870 | B1 | 2/2004 | Palm | |
| 7,621,405 | B2 | 11/2009 | Schweitzer | |
| 7,673,752 | B2 * | 3/2010 | Levy | B65D 73/0078 206/534 |
| 8,616,373 | B2 | 12/2013 | Hansen | |
| 9,090,115 | B2 | 7/2015 | Shields | |
| 9,630,741 | B2 | 4/2017 | McClaughry | |
| 9,845,183 | B2 | 12/2017 | Bailey | |
| 10,704,200 | B2 | 7/2020 | Pang et al. | |
| 10,822,468 | B2 | 11/2020 | Tilton | |
| 10,844,543 | B2 | 11/2020 | Pang et al. | |
| 2007/0187273 | A1 | 8/2007 | Grosskopf | |
| 2011/0000802 | A1 * | 1/2011 | Weiss | B64C 39/024 493/405 |

(Continued)

*Primary Examiner* — Luan K Bui
(74) *Attorney, Agent, or Firm* — UB Greensfelder LLP; Richard C. Himelhoch

(57) ABSTRACT

A trapped tray product packaging having a paperboard or a molded pulp tray trapped between a first panel and a second panel is provided. The first panel has an opening for placement of the tray. The tray includes a lip that is trapped between the first panel and the second panel. The first and second panels can be formed from paperboard.

20 Claims, 8 Drawing Sheets

(56) References Cited

U.S. PATENT DOCUMENTS

| | | | | |
|---|---|---|---|---|
| 2014/0216970 | A1* | 8/2014 | Mattiucci ..... | B65D 75/36<br>206/471 |
| 2015/0136642 | A1 | 5/2015 | Shields | |
| 2016/0001917 | A1 | 1/2016 | Gould et al. | |
| 2016/0229612 | A1 | 8/2016 | Bailey | |
| 2016/0230343 | A1 | 8/2016 | Pang et al. | |
| 2016/0340833 | A1 | 11/2016 | Pang et al. | |
| 2017/0002517 | A1 | 1/2017 | Pang et al. | |
| 2018/0135252 | A1 | 5/2018 | Pang et al. | |
| 2018/0202106 | A1 | 7/2018 | Pang et al. | |
| 2018/0209098 | A1 | 7/2018 | Bushhouse et al. | |
| 2018/0265270 | A1 | 9/2018 | McClaughry | |
| 2020/0032027 | A1 | 1/2020 | Tilton | |
| 2020/0354894 | A1 | 11/2020 | Giuste et al. | |

* cited by examiner

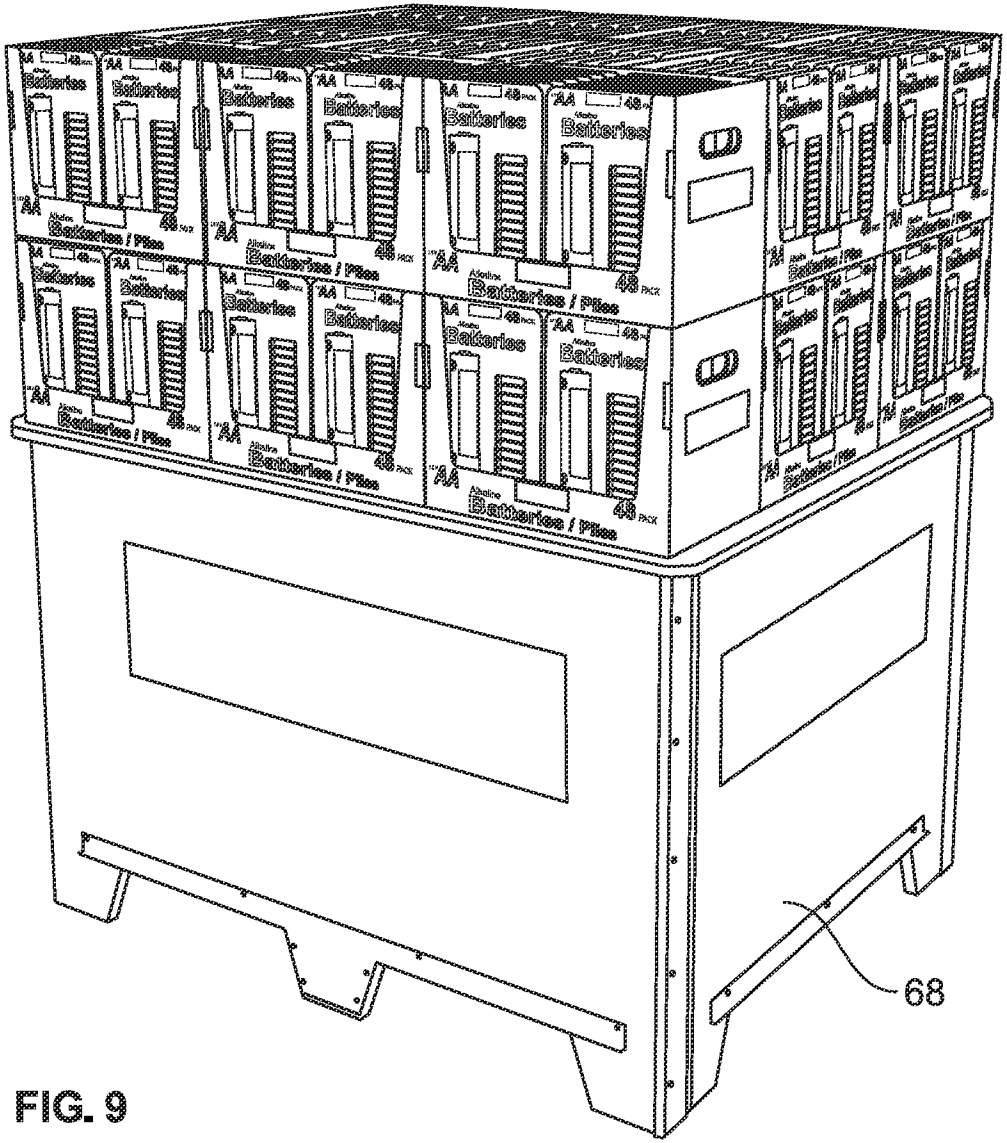
FIG. 9
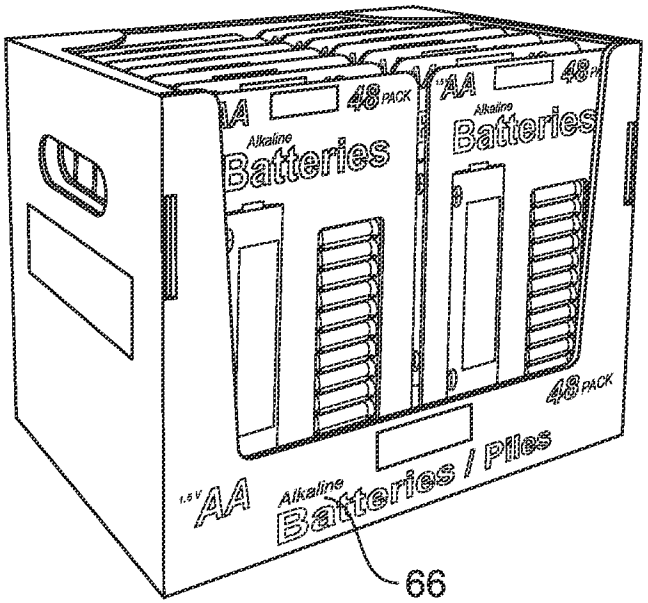

PLASTIC-FREE TRAPPED TRAY PACKAGING

CROSS-REFERENCE TO RELATED APPLICATIONS

The present application is a continuation of U.S. patent application Ser. No. 17/178,321 filed Feb. 18, 2021, which claims priority to and the benefit of U.S. Provisional Patent Application No. 62/980,781 filed Feb. 24, 2020, the contents of which are incorporated herein by reference and made a part hereof.

FEDERALLY SPONSORED RESEARCH OR DEVELOPMENT

N/A

FIELD OF THE INVENTION

The present invention is generally directed to a trapped tray product packaging with entirely recyclable materials such as paperboard and/or molded pulp to replace thermoplastic-containing blister packaging.

DESCRIPTION OF THE PRIOR ART

There is an urgent need to reduce the amount of plastic in consumer packaging. Blister packaging is typically used for small consumer goods, pharmaceuticals, and foods and consists of a tray of a thermoplastic material sealed by lid stock of paperboard, plastic or aluminum foil. Koch Pac-Systeme GmbH sells a blister package with 100% recyclable material including a paperboard tray for holding product that is covered with a paperboard panel bearing printed indicia of the product contained. The paperboard panel can have a portion removed to provide a viewing window for the contained product. The viewing window is of a size to provide a clear view of the product but small enough to securely retain the product. Typically, the paperboard panel or tray has to be torn open to remove the product, thus, it is inherently tamper evident.

The present invention provides an alternative blister package with 100% recyclable material but utilizes a paperboard tray or a preformed molded pulp tray together with paperboard panels to form a reliable package free from thermoplastic materials. This is an ecology-friendly package.

SUMMARY OF THE INVENTION

The present invention is directed to a trapped tray product packaging having a molded pulp tray or a folded paperboard tray, and a lid stock attached thereto to seal a compartment of the tray.

In accordance with one aspect of the invention a trapped tray packaging system is provided. The trapped tray packaging system comprises a back panel having a first opening and a tray having a bottom wall, a side wall extending upward from the bottom wall and a lip or flange extending outward from a top portion of the side wall. The lip is generally perpendicular to the side wall. The system also includes a front panel having a first opening. The bottom wall and the side wall of the tray are positioned in the opening in the back panel and the lip is trapped between the front panel and the back panel.

The system can hold a variety of products in the tray which, in certain embodiments, can be seen through the opening in the front panel. In such instances the tray can include a translucent film extending across a top portion of the tray. In other embodiments the tray can include a top panel made of the same material as the rest of the tray.

The tray can be formed from a molded pulp material. This molded pulp material can be debossed with a graphic if desired. Alternatively, the tray can be formed from a folded or pressed paperboard material.

The back panel can be formed from a paperboard material. Similarly, the front panel can be formed from a paperboard material. In one aspect of the invention, the front panel is connected to the back panel along an edge of the front panel and an edge of the back panel. In this instance, the front panel and the back panel can be from a single blank of material.

The back panel can include a second opening spaced from the first opening. This allows the back panel to accommodate a tray that includes a first well having a first bottom wall portion having a first side wall portion extending upward from the first bottom wall portion and a second well having a second bottom wall portion having a second side wall portion extending upward from the second bottom wall portion. The tray comprises a bridge portion between the first well and the second well.

To secure the packaging system the front panel is glued to the back panel. Other adhesives or sealing methods can also be used.

In accordance with another aspect of the present invention, a trapped tray packaging system comprises a first rectangular shaped panel having a first opening and a second rectangular shaped panel having a first opening and a first edge hingedly connected to a first edge of the first rectangular shaped panel. The system also includes a tray having a bottom wall, a side wall extending upward from the bottom wall, and a lip extending outward from a top edge of the side wall where the lip extends outward past the edges of the opening in the first panel and the edges of the opening in the second panel and is trapped between the panels.

The tray can be formed from a molded pulp material. Alternatively, the tray can be formed from a paperboard material.

The first rectangular shaped panel and the second rectangular shaped panel can be formed from a single blank of material. In this configuration, the second rectangular shaped panel is hingedly connected to the first rectangular shaped panel by a fold line in the blank.

The trapped tray packaging system can further comprise a film extending over an open end of the tray. Alternatively, the tray can be open or have a top wall enclosing the contents of the tray.

The first panel can be configured to include a second opening spaced from the first opening in the front panel and the second panel can also a second opening spaced from the first opening in the second panel. The two openings in each panel can accommodate the tray having a first well including a first bottom wall portion having a first side wall portion extending upward from the first bottom wall portion and a second well having a second bottom wall portion including a second side wall portion extending upward from the second bottom wall portion. The tray comprises a bridge portion between the first well and the second well.

Other features and advantages of the invention will be apparent from the following specification and claims taken in conjunction with the following Figures.

BRIEF DESCRIPTION OF THE DRAWINGS

To understand the present invention, it will now be described by way of example, with reference to the accompanying drawings in which:

FIG. 9 is a perspective view of a plurality of the trapped tray packaging systems of FIG. 7 in a display;

DETAILED DESCRIPTION

Figure 2:
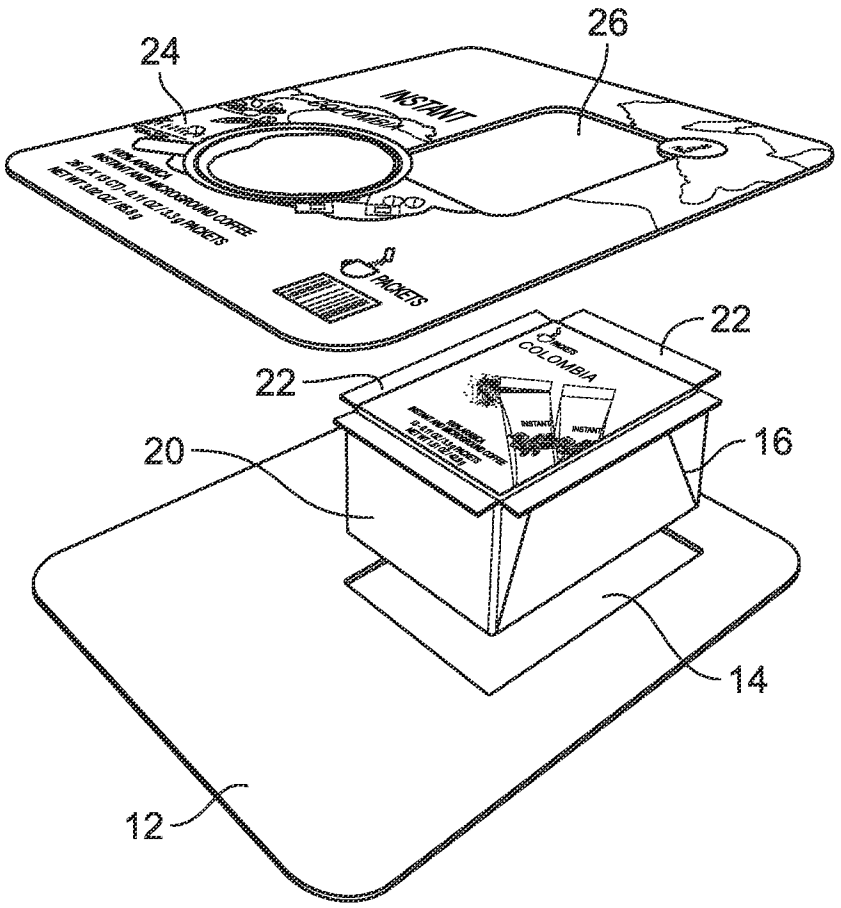
FIG. 2 is an exploded view of the trapped tray package system of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The Figures show numerous embodiments of trapped tray packaging having a back panel, a front panel, and a tray therebetween. The back panel is preferred but is optional. The back panel has a cutout to receive the tray. The front panel is placed on top of the tray and the back panel and pressed there against to permanently connect the parts to form a tamper evident packaging. The back panel and front panel are made from a preprinted paperboard or corrugated and the tray is made from paperboard or molded pulp, and more preferably molded pulp. The front panel can also have a cutout portion to form a window to display the contained product. The window is dimensioned to securely retain the product while providing a view and feel of the product inside. The front panel is attached to the tray by glue or another adhesive or a cohesive using standard sealing equipment well known to those of ordinary skill in the art.

As mentioned above, in certain embodiments the unitary body of the tray is shaped or molded from a pulp material and will be referred to as molded pulp. Molded pulp is a material of a recycled paperboard and newspaper and is formed into the desired shape using molds. Suitable techniques include slush molding, vacuum forming, transfer molding, take-off molding, and cure-in-the-mold technology to name a few. The molded pulp material can have additives such as: corn starch based biodegradable polymers (injection molded or vacuum/thermo formed); structural foam additives (injection molded); sustainable wood-plastic composites from bio-based polyamide 11, beech wood fiber or other similar mix; HIPS (high impact polystyrene); and MIPS (medium impact polystyrene). The molded pulp provides a rigid, light weight substrate.

In a preferred form of the invention, the molded pulp material will be capable of recycle using standard paperboard recycling techniques as opposed to recycling techniques for polymeric materials. Also, the unitary body is "disposable" meaning that it can be rid of by placing in standard waste disposal streams and capable of being buried in landfills. It is also desirable the molded pulp material be a "sustainable packaging material"—made of recycled material and capable of being recycled.

FIGS. 1-4 illustrate a trapped tray packaging system 10 in accordance with the present invention. The system 10 includes a generally rectangular shaped back panel 12 having a rectangular opening 14. The back panel 12 can be formed from paperboard. A tray 16 having a bottom wall 18 and side walls 20 extending upward from the bottom wall is inserted in the opening 14. The tray 16 also includes a lip or flange 22 extending outward from (e.g., generally perpendicular to) a top edge of the side walls 20. The system also includes a rectangular front panel 24 having a rectangular opening 26. The opening 16 is generally aligned with the opening 14 in the back panel 12. While both openings 14, 16 are shown as rectangular, one or both can be any of a variety of shapes. Moreover, the openings 14, 16 do not have to be the exact same size.

The opening 14 in the back panel 12 is sized to be big enough to allow the bottom wall 18 and the side walls 20 of the tray 16 to be inserted through the opening 14, but small enough to prevent the lip 22 of the tray from going through the opening 14. The opening 26 in the front wall 24 is also smaller than all or most of an outer perimeter of the lip 22. To form the packaging system 10, the front wall 24 is connected to the back wall 12. This traps the lip 22 of the tray 16 between the front wall 24 and the back wall 12 and thus, holds the tray 16 in place with the bottom of the tray 18 and the side walls 20 extending through the opening 14 in the back wall 12.

Figure 1:
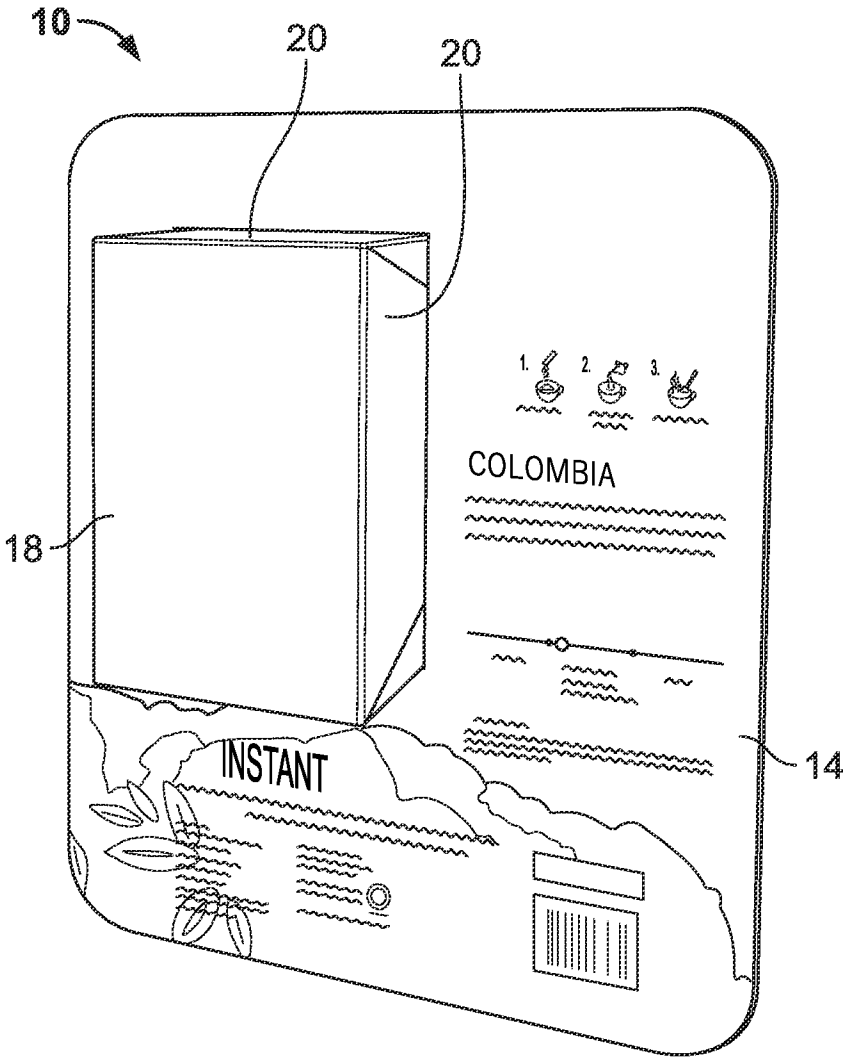
FIG. 1 is perspective view of a trapped tray package system in accordance with an aspect of the present invention.
Figure 4:
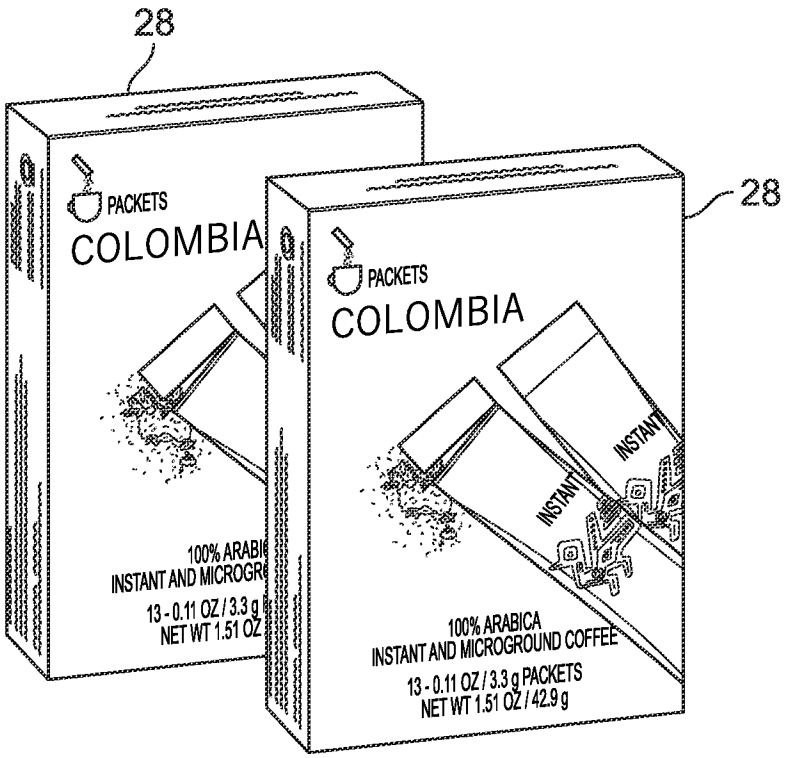
FIG. 4 is a perspective view of a product that is placed in the tray of FIG. 1.
Figure 3:
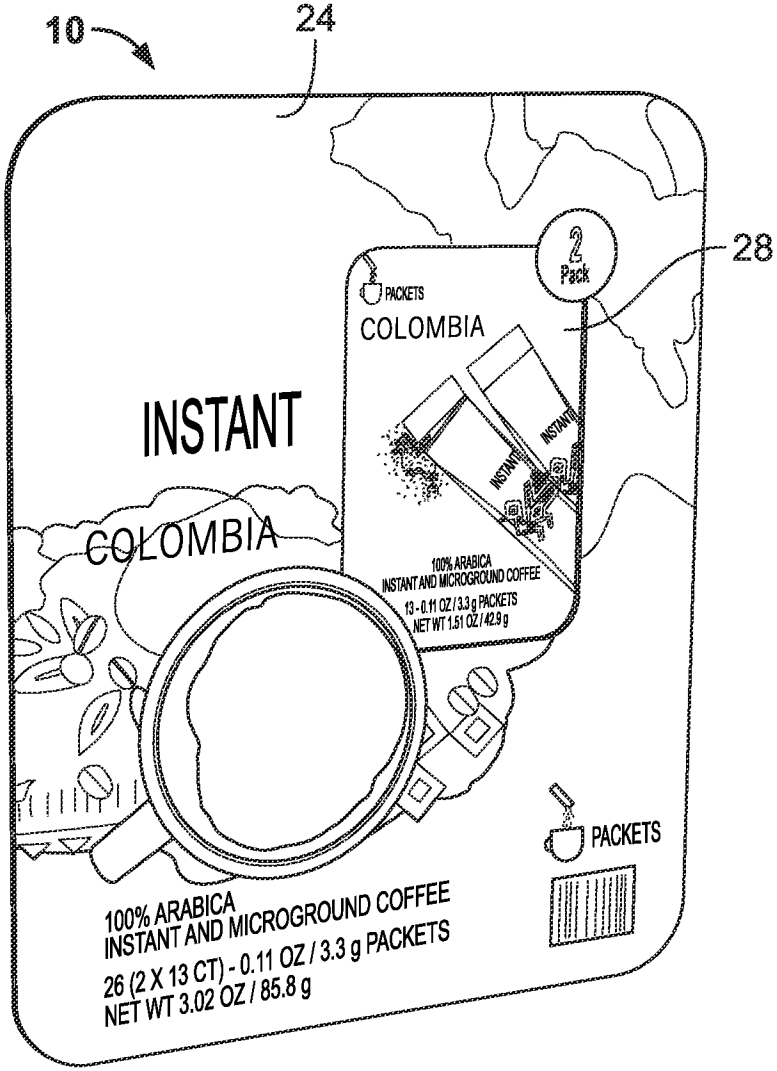
FIG. 3 is a front view of the trapped tray packaging system of FIG. 1.

FIG. 1 shows the back panel 12 and the tray 16 extending outward from the back panel 12. FIG. 3 shows the front panel 24 and the inner contents 28 of the tray 16. The inner contents 28 (shown alone in FIG. 4) can be any product(s) being shipped and/or sold in the packaging system 10. As illustrated in FIG. 1, the front panel 24 and trapped tray 16 appear flush (i.e., the tray 16 only extends outward from the back wall 12). Although not shown in FIGS. 1-4, the tray 16 can includes a top wall or a translucent film covering the otherwise open side of the tray 16 opposing the bottom wall 18. Graphics can be applied to the back wall 12, front wall 24 and/or the tray 16.

Figure 12:
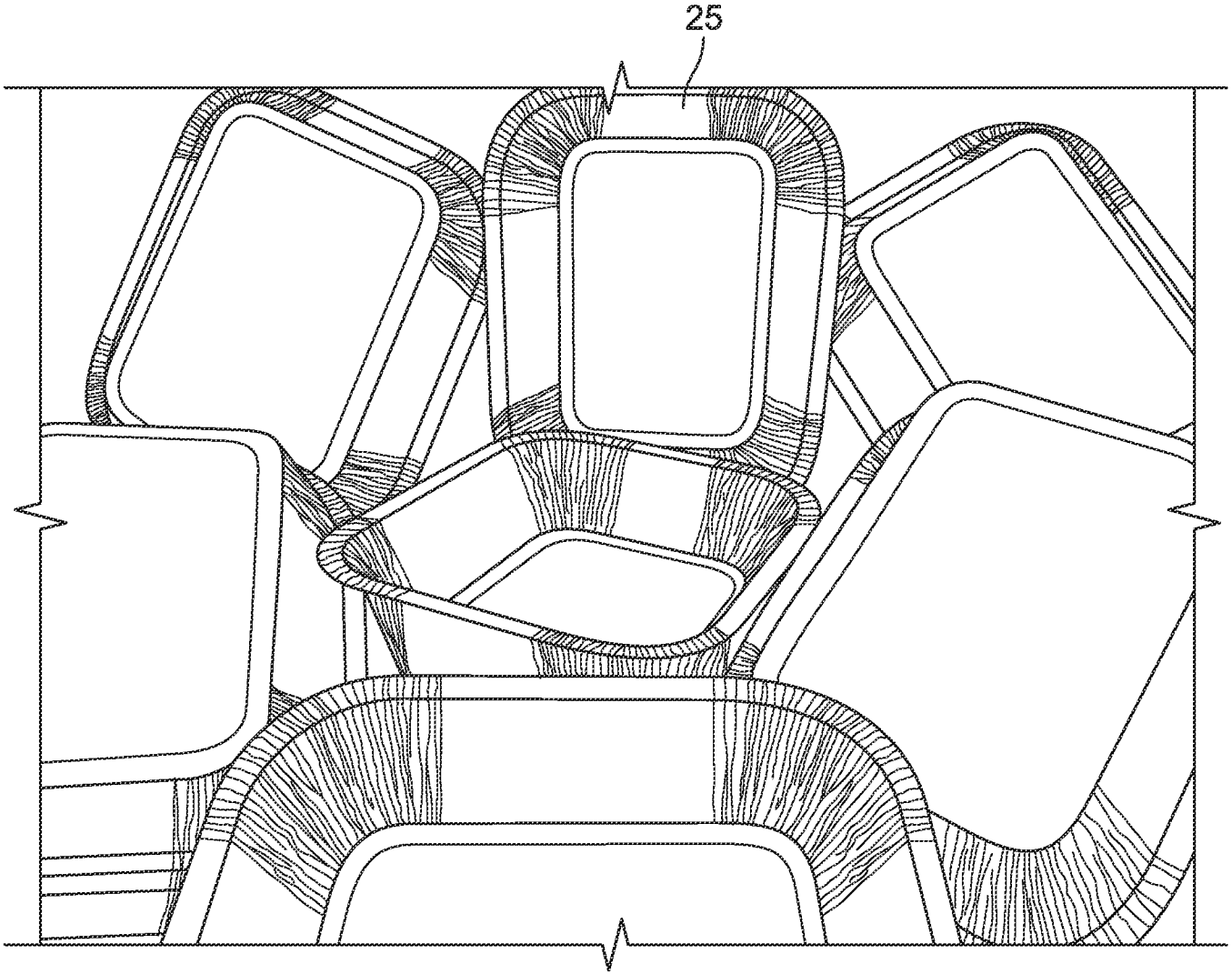

The tray 16 illustrated in FIGS. 1-4 can be formed from a paperboard material. The paperboard can be a folded paperboard or a pressed paperboard (see tray 25 in FIG. 12). The pressed paperboard can be formed wet in a mold (similar to the forming of paper plates).

Similarly, the front and back panels 24, 12 can also be formed in a paperboard material. In an alternative aspect of the invention, the tray can be formed from a molded pulp material. Such a tray 30 is shown in FIGS. 5 and 6.

Figure 6:
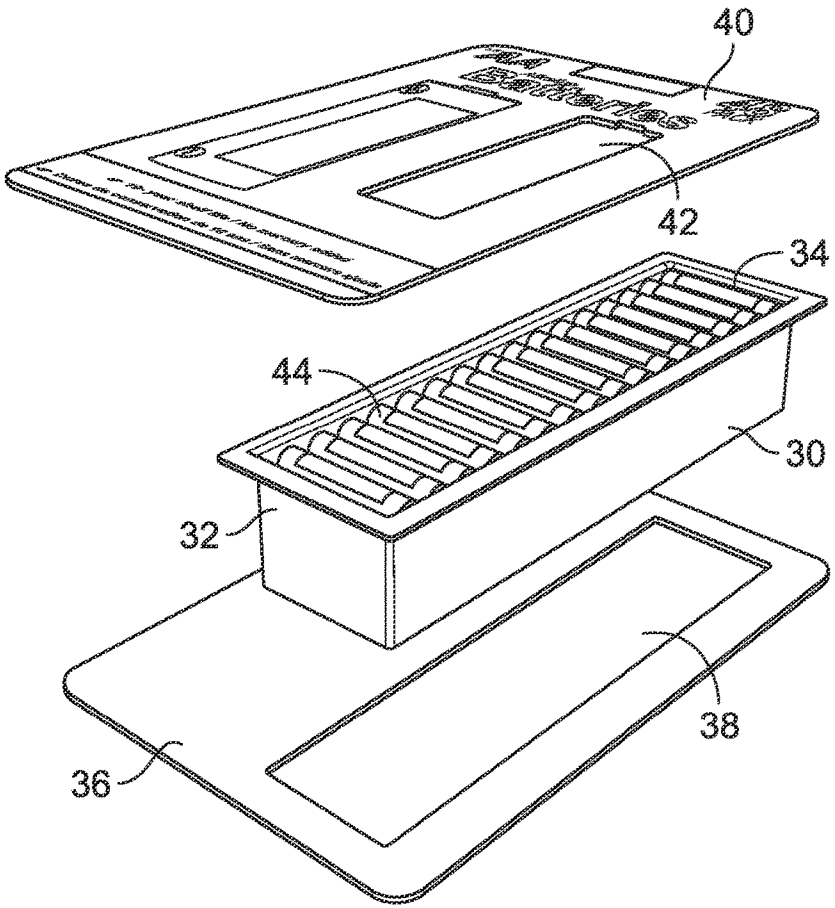
FIG. 6 is an exploded view of the trapped tray package system of FIG. 5.
Figure 5:
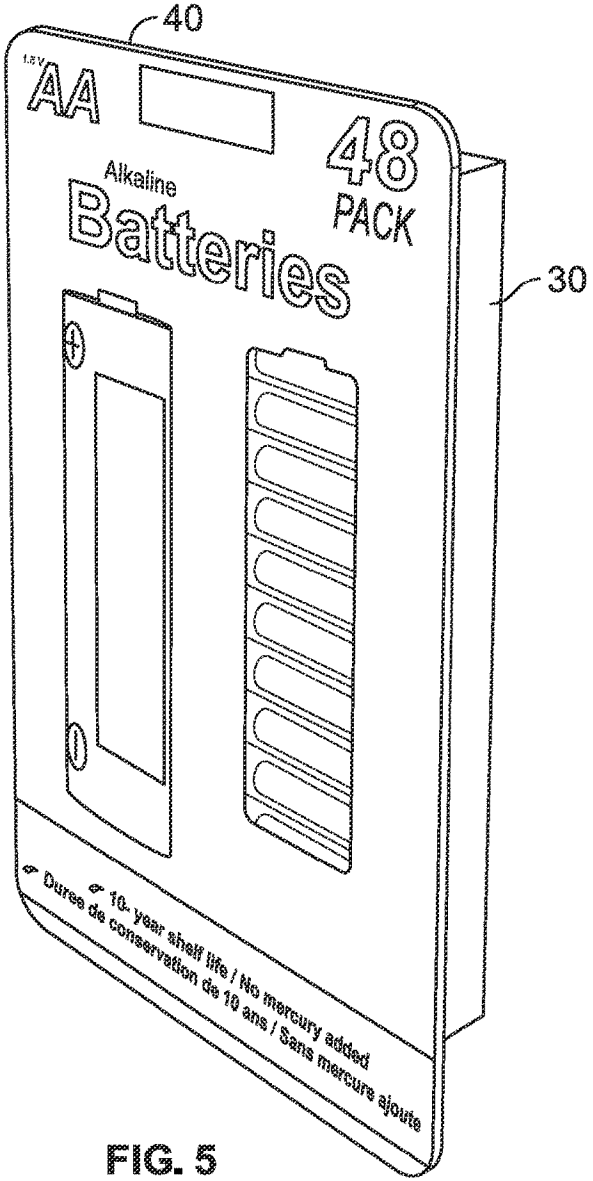
FIG. 5 is a perspective view of a trapped tray package system in accordance with another aspect of the present.

Referring to FIGS. 5 and 6, the molded pulp tray 30 includes a bottom wall and side walls 32 extending upward from the bottom wall. A lip 34 extends outward from a top edge of the side walls 32. The tray 30 is trapped between a back wall 36 having an opening 38 and a front wall 40 having an opening 42. A plurality of products 44 (in this case, batteries) are shown in the tray 30.

Figure 8:
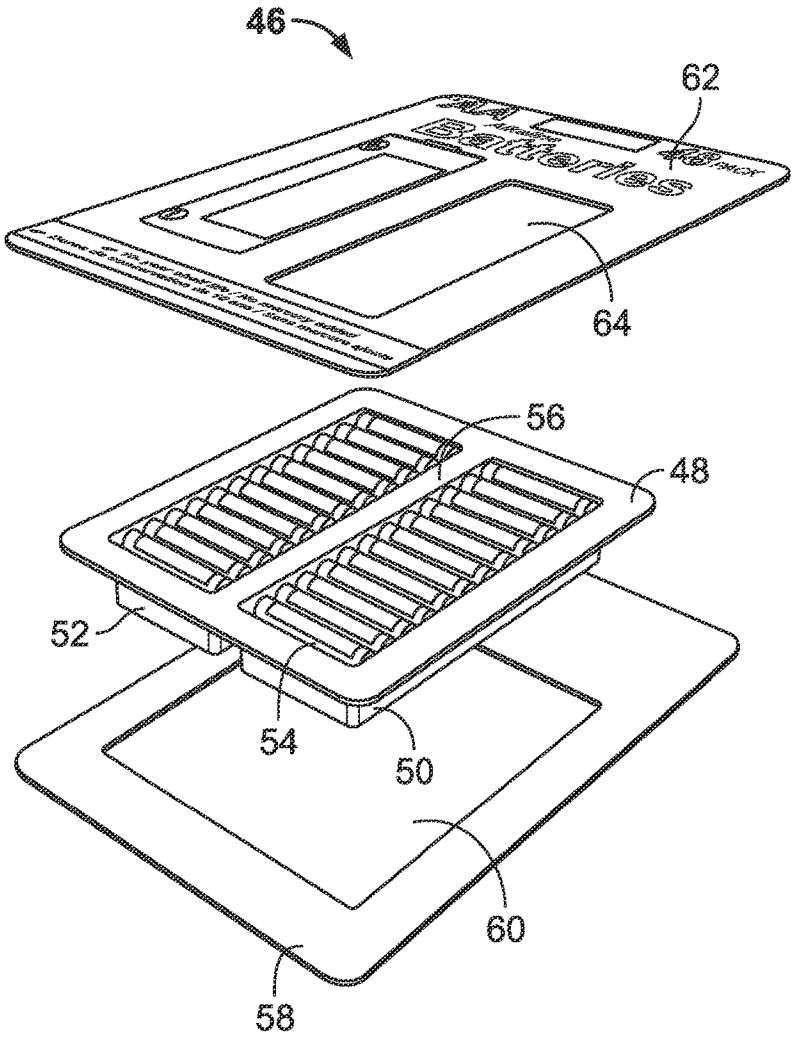
FIG. 8 is an exploded view of the trapped tray package system of FIG. 7.
Figure 7:
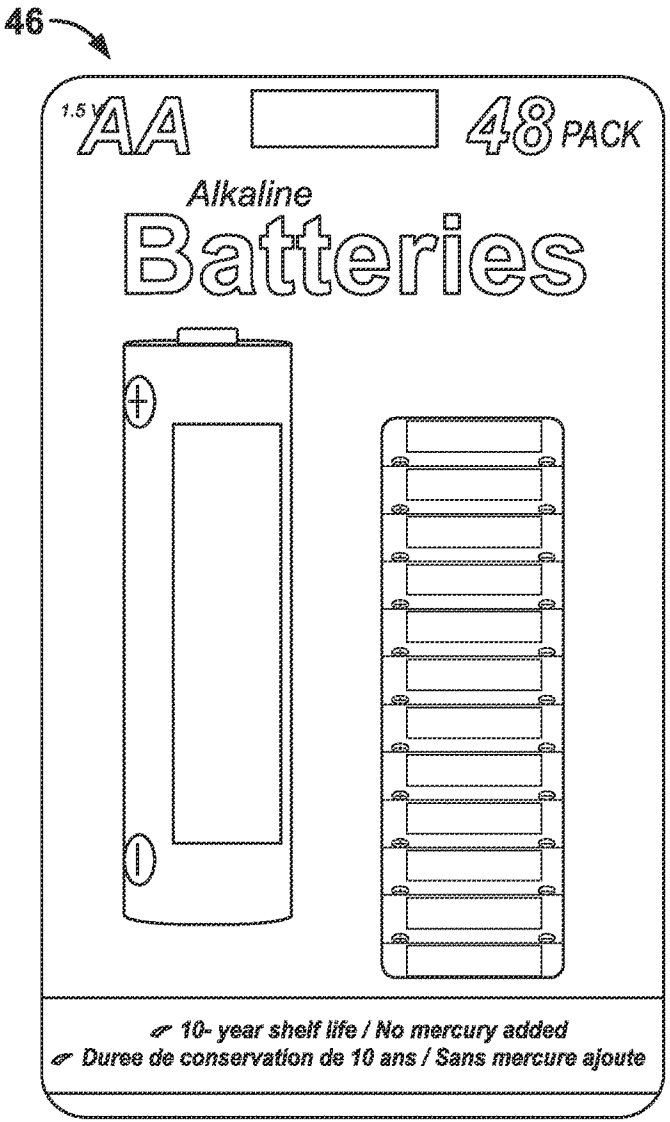
FIG. 7 is a front plan view of a trapped tray package system in accordance with another aspect of the present.

FIGS. 7 and 8 show another aspect of the present invention. As illustrated in FIG. 7, a trapped tray packaging system 46 appears similar to the system shown in FIG. 5. However, as illustrated in the exploded view of FIG. 8, the system 46 of FIG. 7 has a modified tray 48. The tray 48 has a first well 50 having a bottom wall and side walls extending upward therefrom, and a second well 52 having a bottom wall and side walls extending upward therefrom. An outwardly extending lip 54 surrounds the two wells 50, 52 of the tray 48, and a bridge portion 56 extends between the wells 50, 52 separating the wells 50, 52 by the width of the bridge 56.

As shown in FIG. 8, the system 46 includes a back wall 58 having an opening 60 large enough to accommodate both wells 50, 52 of the tray 48. In contrast, the system includes a front wall 62 having an opening 64 that is sized to only expose the contents of one of the wells. Similar to the other systems shown, the lip 54 of the tray 48 is trapped between the front wall 62 and the back wall 58. A plurality of the systems 48 can be placed upright in a box 66, and multiple boxes 66 can be part of a display 68 as shown in FIG. 9

Figure 10:
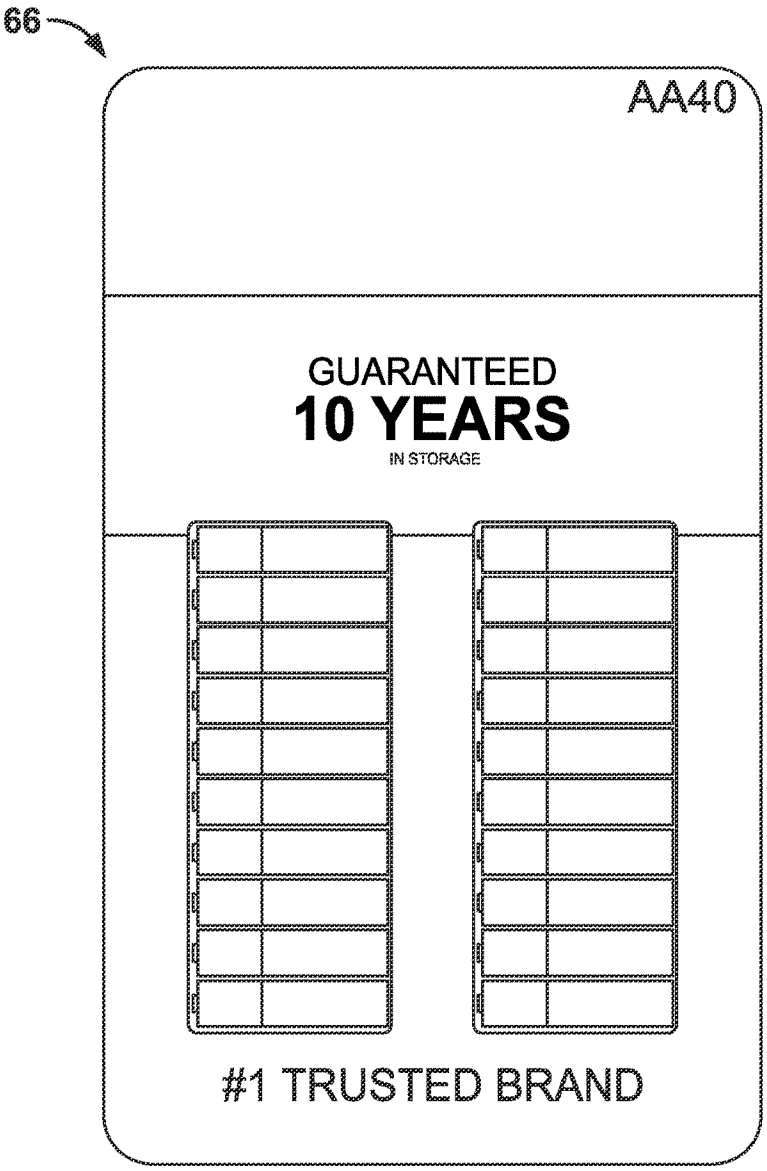
FIG. 10 is a front plan view of a trapped tray package system in accordance with another aspect of the present.
Figure 11:
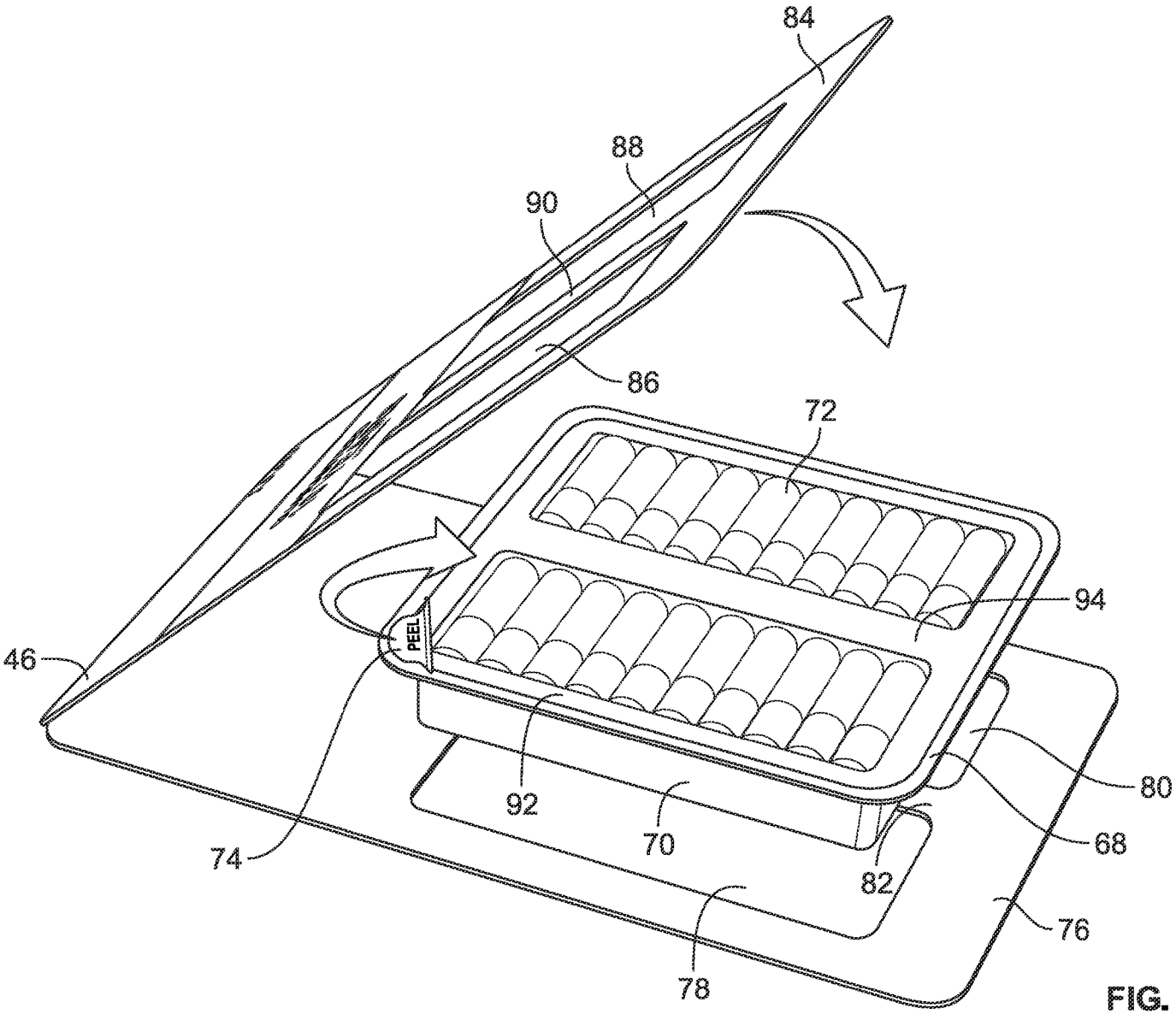
FIG. 11 is an exploded view of the trapped tray package system of FIG. 10; and, FIG. 12 is a perspective view of a pressed paperboard tray.

FIGS. 10 and 11 disclose another trapped tray packaging system 66. The system 66 includes a tray 68 having two wells 70, 72 similar to the tray 48 in FIG. 8. The tray 66 includes a peel-able/re-sealable film 74 spanning across the open ends of the wells 70, 72.

As shown in FIG. 11, the system 66 includes a back panel 76 having a first opening 78 and a separate second opening 80 with a bridge of material 82 between the two openings 78, 80. The system 66 also includes a matching front panel 84 having a first opening 86 and a separate second opening 88. Again, a bridge of material 90 is between the two openings 86, 88. When the front panel 84 is connected to the back panel 76, the lip 92 of the tray 68 is trapped between the panels 84, 76. Additionally, a bridge 94 between the two wells 70, 72 on the tray 68 is also trapped between the bridges 82, 92 of the panels 84, 76.

As also illustrated in FIG. 11, the front panel 84 is hingedly connected to the back panel 76 by a hinge 96 along an edge of both panels 84, 76. The hinge 96 can be a fold line between the panels 84, 76. In this regard, the front panel 84 and the back panel 76 can be formed from a single blank of material.

The trapped tray packaging with paperboard panels can also have inserts that are dimensioned to be placed inside the tray to support a product or to provide dunnage. The insert can also provide additional surfaces to be printed on to provide instructions or product information, for example. The inserts can be made from paperboard, corrugated, molded pulp and other environmentally friendly alternatives. The paperboard inserts can be foldable from a stowed position to a deployed position. In the stowed position, the insert lays flat to save space. When deployed, the insert is folded to erect features upstanding from the insert to form product support surfaces and product retention features.

Many modifications and variations of the present invention are possible in light of the above teachings. It is, therefore, to be understood within the scope of the appended claims the invention may be protected otherwise than as specifically described.

We claim:

1. A trapped tray packaging system comprising:

a back panel having a first opening;

a tray having a first well having a first bottom wall and a first side wall extending upward from the bottom wall and a first lip extending outward from the first side wall; and, a front wall having a first opening for visibly exposing products in the tray and a second opening for visibly exposing products in the tray, the second opening spaced from the first opening by a first bridge portion wherein the front wall, first opening and second opening form a planar portion across an entire front side of the packaging system.

2. The trapped tray packaging system of claim 1 wherein the tray includes a second well having a second bottom wall and a second side wall extending upward from the second bottom wall and a second lip extending outward from the second side wall, the second well spaced from the first well by a second bridge portion.

3. The trapped tray packaging system of claim 2 wherein the front wall is connected to the back wall.

4. The trapped tray packaging system of claim 2 wherein the front wall is connected to the back wall along a top edge.

5. The trapped tray packaging system of claim 2 wherein the tray is formed from a molded pulp material.

6. The trapped tray packaging system of claim 5 wherein the front wall and the back wall are formed from paperboard.

7. The trapped tray packaging system of claim 2 wherein the tray includes a translucent film spanning across an open end of the first well and an open end of the second well.

8. The trapped tray packaging system of claim 7 wherein the film is peel-able and re-seelable.

9. The trapped tray packaging system of claim 1 wherein the back wall includes a second opening spaced from the first opening by a back wall bridge portion.

10. The trapped tray packaging system of claim 1 wherein the back wall is glued to the front wall.

11. The trapped tray packaging system of claim 1 wherein the tray is formed from paperboard.

12. The trapped tray packaging system of claim 9 wherein the first opening in the back wall has a generally rectangular shape and the second opening in the back wall has a generally rectangular shape.

13. The trapped tray packaging system of claim 1 wherein the first opening in the front wall has a generally rectangular shape and the second opening in the front wall has a generally rectangular shape.

14. The trapped tray packaging system of claim 1 wherein the tray includes a debossed graphic.

15. A trapped tray packaging system comprising:

a back wall having a first opening and a second opening;

a tray having a first well and a second well and a lip extending outward around the first well and the second well; and, a front wall having a first visible opening and a second visible opening wherein the front wall, first opening and second opening form a planar portion across an entire front side of the packaging system.

16. The trapped tray packaging system of claim 15 wherein the front wall and the back wall are formed from paperboard.

17. The trapped tray packaging system of claim 16 wherein the tray is formed from paperboard.

18. The trapped tray packaging system of claim 16 wherein the tray is formed from a molded pulp.

19. The trapped tray packaging system of claim 15 wherein the tray includes a peel-able and re-sealable translucent film spanning across an open end of the first well and an open end of the second well.

20. The trapped tray packaging system of claim 15 wherein the back wall includes a back wall bridge between the first opening and the second opening in the back wall, the tray includes a tray bridge between the first well and the second well, and the front wall includes a front wall bridge between the first opening and the second opening in the front wall.

* * * * *